US007040945B2

(12) United States Patent
Yabe

(10) Patent No.: US 7,040,945 B2
(45) Date of Patent: May 9, 2006

(54) APPARATUS FOR FORMING BARRIER RIBS ON SUBSTRATE FOR FLAT PANEL DISPLAY WITH OSCILLATION MECHANISM FOR RIB MATERIAL DISCHARGE

(75) Inventor: Manabu Yabe, Kyoto (JP)

(73) Assignee: Dainippon Screen Mfg. Co., Ltd., Kyoto (JP)

( * ) Notice: Subject to any disclaimer, the term of this patent is extended or adjusted under 35 U.S.C. 154(b) by 318 days.

(21) Appl. No.: 10/322,707

(22) Filed: Dec. 19, 2002

(65) Prior Publication Data

US 2003/0122486 A1 Jul. 3, 2003

(30) Foreign Application Priority Data

Dec. 21, 2001 (JP) ..... P2001-389188

(51) Int. Cl.
*H01J 9/00* (2006.01)
*B05D 3/12* (2006.01)

(52) U.S. Cl. ..... 445/24; 156/540; 427/356

(58) Field of Classification Search ..... 445/24, 445/25; 156/540, 500, 232; 118/100, 500; 65/102, 106, 42; 427/356, 64, 165
See application file for complete search history.

(56) References Cited

U.S. PATENT DOCUMENTS 5,776,545 A 7/1998 Yoshiba et al.
5,833,446 A * 11/1998 Smith et al. ..... 418/201.1
6,482,062 B1 * 11/2002 Yao et al. ..... 445/24

FOREIGN PATENT DOCUMENTS

JP 9-92134 4/1997
JP 2001-000907 A 1/2001
JP 2001-0003183 1/2001

* cited by examiner

*Primary Examiner*—Joseph Williams
(74) *Attorney, Agent, or Firm*—McDermott Will & Emery LLP

(57) ABSTRACT

In a barrier-rib forming apparatus for forming barrier ribs on a substrate by discharging rib material from a discharge part, an oscillating mechanism for oscillating the discharge part in a direction perpendicular to a traveling direction of a stage which supports the substrate is provided to form barrier ribs of waveform on the substrate. The travel of the stage is performed twice, and at the second travel of the stage, each of barrier ribs is formed between adjacent ones of the already-formed barrier ribs. The barrier rib formed at the first travel of the stage and that formed at the second travel of the stage are disposed symmetrically to each other with respect to an axis parallel to the travel direction of the stage. With this formation of barrier ribs, it is possible to manufacture a panel which allows improvement in luminance of a plasma display.

12 Claims, 10 Drawing Sheets

V — V

APPARATUS FOR FORMING BARRIER RIBS ON SUBSTRATE FOR FLAT PANEL DISPLAY WITH OSCILLATION MECHANISM FOR RIB MATERIAL DISCHARGE

BACKGROUND OF THE INVENTION

1. Field of the Invention

The present invention relates to a technique for forming barrier ribs of a panel used for a flat panel display such as a plasma display and an organic electroluminescence (EL) display.

2. Description of the Background Art

Conventionally, barrier ribs are formed on a rear panel used for a plasma display by various methods. Among methods for forming barrier ribs, a sandblast method, a screen-printing method, a lift-off method and the like are well known, and a method of forming barrier ribs by discharging rib material from a nozzle is recently proposed (e.g., in Japanese Patent Application Laid-Open Gazette No. 9-92134).

On the other hand, in a panel of a plasma display, luminescent areas and non-luminescent areas ares provided alternately in an area between the barrier ribs. Then, in order to narrow the interval between the barrier ribs in the non-luminescent area, a technique of forming barrier ribs each of waveform by the sandblast method is also proposed.

In a method of discharging rib material from a nozzle (hereinafter, referred to as "nozzle method"), conventionally, since a pitch of the nozzles and that of the barrier ribs coincide with each other, a lot of nozzles need to travel in a straight line with respect to the substrate and only linear (stripe-shaped) barrier ribs can be formed. Therefore, it is impossible to reduce the non-luminescent area which does not contribute to light emission and to improve the luminance of the plasma display.

SUMMARY OF THE INVENTION

It is an object of the present invention to form barrier ribs which allow reduction of non-luminescent areas, with a technique of discharging rib material from a group of discharge ports to form barrier ribs on a substrate.

The present invention is intended for an apparatus for forming barrier ribs on a substrate for a flat panel display.

According to an aspect of the present invention, the apparatus comprises a discharge part having a group of discharge ports for discharging rib material to the substrate; a transfer mechanism for transferring the discharge part relatively to the substrate in a first direction along a main surface of the substrate; and an oscillating mechanism for oscillating the discharge part relatively to the substrate in a second direction which is perpendicular to the first direction and parallel to the main surface.

With this apparatus, it is possible to form the barrier ribs each of periodic waveform on the substrate.

According to another aspect of the present invention, the apparatus further comprises another discharge part positioned in the first direction with respect to the discharge part, being transferred by the transfer mechanism together with the discharge part and oscillated by the oscillating mechanism; and a control part for synchronizing an operation of the transfer mechanism with that of the oscillating mechanism, and in the apparatus, the another discharge part oscillates in synchronization with oscillation of the discharge part, a plurality of first barrier ribs are formed by travel of the discharge part and a plurality of second barrier ribs are formed by travel of the another discharge part, and the control part controls the operations so that the plurality of second barrier ribs are disposed alternately with the plurality of first barrier ribs and adjacent ones are almost symmetrical to each other with respect to an axis parallel to the first direction.

According to still another aspect of the present invention, the apparatus further comprises a control part for synchronizing an operation of the transfer mechanism with that of the oscillating mechanism, and in the apparatus, the group of discharge ports includes a first group of discharge ports aligned in the second direction at a predetermined pitch and a second group of discharge ports aligned in the second direction at the predetermined pitch, being shifted by half pitch with respect to the first group of discharge ports, and a distance between the first group of discharge ports and the second group of discharge ports is almost equal to a distance covered by the discharge part during oscillation of the discharge part by an integral multiple of cycle and a half.

With the first group of discharge ports and the second group of discharge ports, it is possible to form the barrier ribs which allow reduction of non-luminescent areas of the flat panel display for a short time.

The present invention is also intended for a method of forming barrier ribs on a substrate of a flat panel display and a panel for the flat panel display.

These and other objects, features, aspects and advantages of the present invention will become more apparent from the following detailed description of the present invention when taken in conjunction with the accompanying drawings.

DESCRIPTION OF THE PREFERRED EMBODIMENTS

<1. The First Preferred Embodiment>

Figure 1:
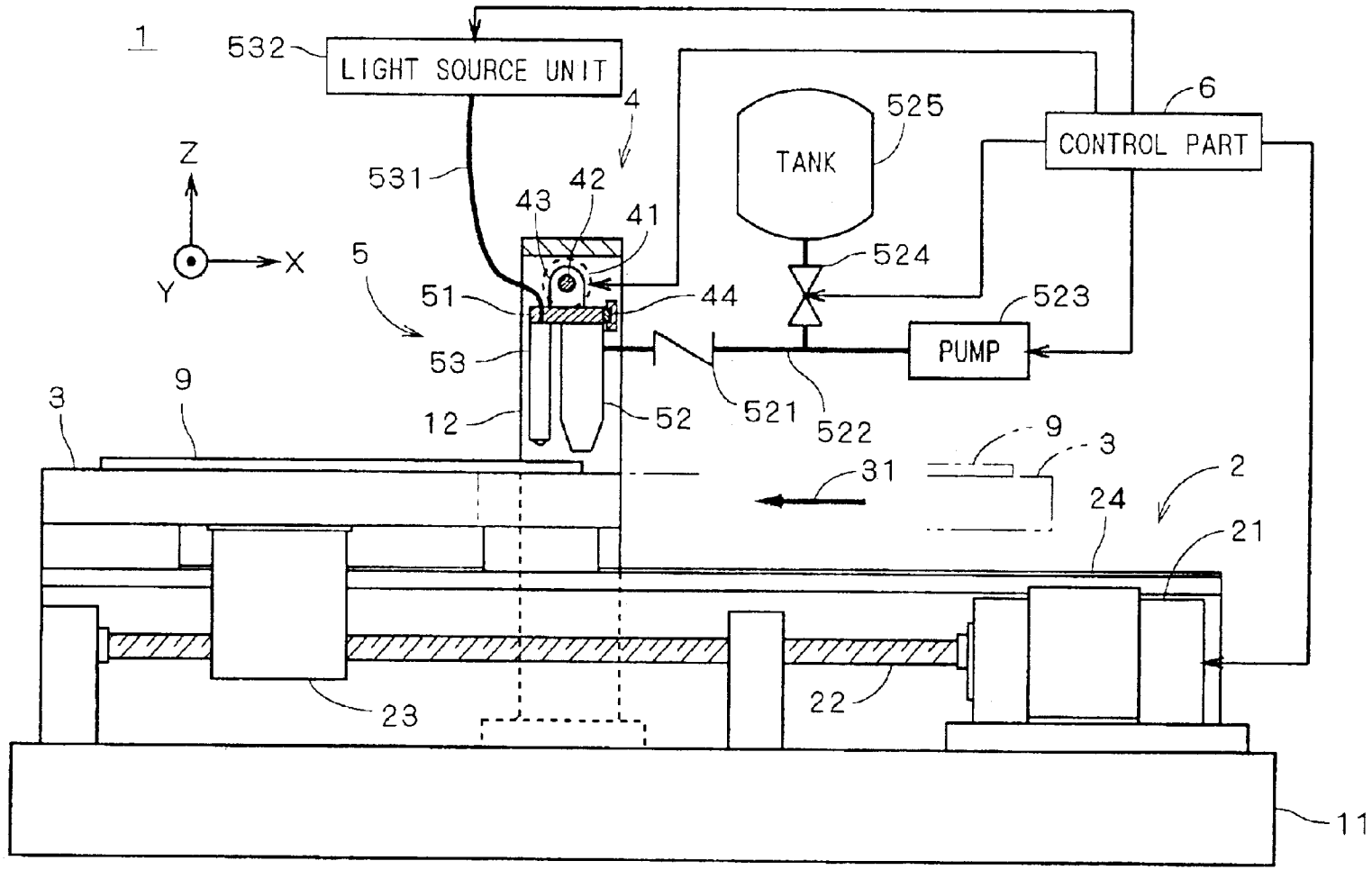
FIG. 1 is a view schematically showing a constitution of a barrier-rib forming apparatus in accordance with a first preferred embodiment.

FIG. 1 is a view schematically showing a constitution of a barrier-rib forming apparatus 1 in accordance with the first preferred embodiment. The barrier-rib forming apparatus 1 is an apparatus for forming barrier ribs on a glass substrate (referred to as "substrate") 9 of a plasma display, and the substrate 9 on which the barrier ribs are formed becomes a panel (usually, rear panel) which is a subassembly of the plasma display through other processes.

In the barrier-rib forming apparatus 1, a stage transfer mechanism 2 is provided on a base 11 and a stage 3 supporting the substrate 9 is capable of traveling in the X direction of FIG. 1 by the stage transfer mechanism 2. A frame 12 is fixed on the base 11 across the stage 3, and a head part 5 is attached to the frame 12 via an oscillating mechanism 4.

The stage transfer mechanism 2 has a structure in which a ball screw 22 is connected to a motor 21 and fitted into a nut 23 which is fixed to the stage 3. A guide rail 24 is fixed above the ball screw 22 and when the motor 21 runs, the stage 3 travels together with the nut 23 along the guide rail 24 in the X direction.

The oscillating mechanism 4 has a motor 41 installed in the frame 12, a ball screw 42 connected to a rotation shaft of the motor 41 and a nut 43 into which the ball screw 42 is fitted, and the nut 43 travels in the Y direction of FIG. 1 by rotation of the motor 41. A base 51 of the head part 5 is attached to the nut 43, and with this structure, the whole head part 5 is capable of traveling in the Y direction. The base 51 is connected to a guide rail 44 fixed on the frame 12 and smoothly guided by the guide rail 44.

The head part 5 has a discharge part 52 provided on a lower surface of the base 51, for discharging rib material onto the substrate 9, and an irradiation part 53 for irradiating the substrate 9 with ultraviolet rays, and a supply pipe 522 having a check valve 521 is attached to the discharge part 52. The supply pipe 522 is branched off into two pipes, one of which is connected to a pump 523 and the other is connected to a tank 525 via a control valve 524. The irradiation part 53 is connected to a light source unit 532 for generating ultraviolet rays through an optical fiber 531.

The motor 21, the motor 41, the pump 523, the control valve 524 and the light source unit 532 are connected to the control part 6, and the barrier-rib forming apparatus 1, using the control part 6 to control these constituents, forms the barrier ribs on the substrate 9.

Figure 2:
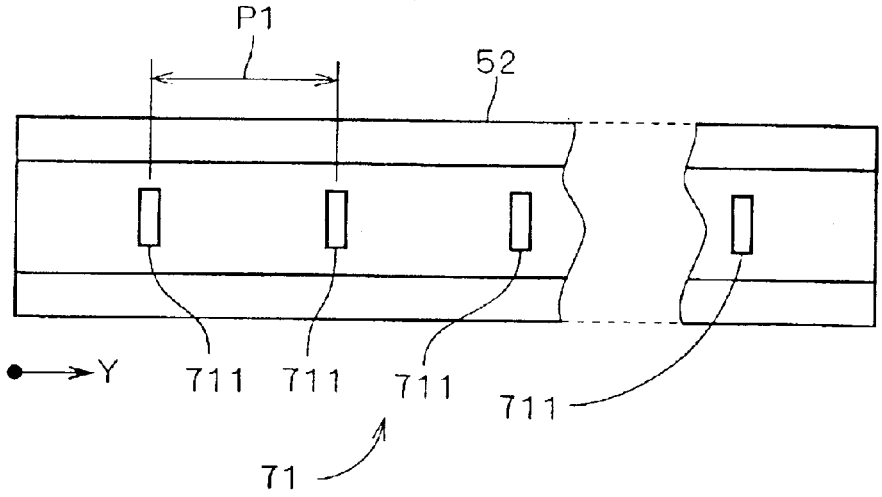
FIG. 2 is a bottom view of a discharge part.

FIG. 2 is a bottom view of the discharge part 52 like a nozzle. In a bottom surface of the discharge part 52 formed are a group of discharge ports 71 for discharging rib material to the substrate 9. The shape and area of each discharge port 711 in the group of discharge ports 71 are determined in accordance with the shape of the barrier rib to be formed on the substrate 9, and a case of rectangular discharge port 711 is shown in FIG. 2.

The discharge ports 711 are formed at a predetermined pitch P1 in the Y direction, and the pitch P1 is twice a pitch P2 of the barrier ribs formed on the substrate 9 (pitch P2 is an average value of distance between the barrier ribs since the barrier ribs are formed in a waveform). In other words, by one discharge of rib material from the group of discharge ports 71, only half the required number of barrier ribs are formed. As a specific example, the pitch is 600 μm, the width of the discharge port 711 in the Y direction is 50 μm and that in the X direction is 400 μm.

Figure 3:
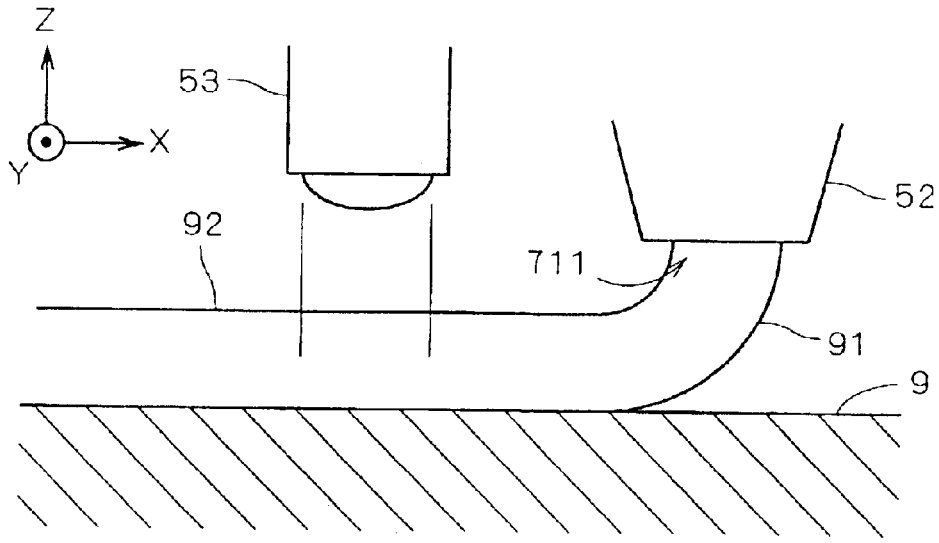
FIGS. 3 and 4 are a side view and a plan view, respectively, showing a state where barrier ribs are formed on a substrate.
Figure 4:
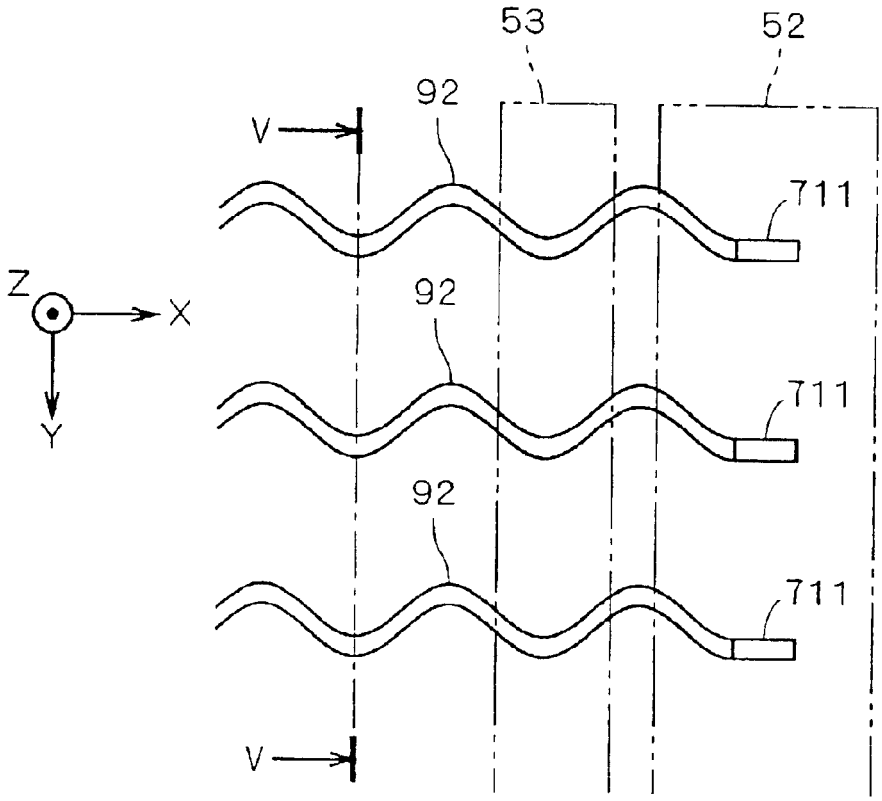

FIG. 3 is a side view showing a state where the barrier ribs are formed on the substrate 9, and FIG. 4 is a plan view thereof (showing only the discharge ports 711 and the rib material discharged therefrom). An operation of the barrier-rib forming apparatus 1 for forming the barrier ribs will be discussed below, referring to FIGS. 1, 3 and 4.

The discharge of rib material from the discharge part 52 is performed by the check valve 521, the pump 523 and the control valve 524 of FIG. 1. First, with control of the control part 6, the pump 523 performs suction while the control valve 524 is open. At this time, since the check valve 521 blocks backflow of the rib material, the rib material is sucked from the tank 525 into the pump 523. Subsequently, with control of the control part 6, the control valve 524 gets closed and the pump 523 performs ejection. With this operation, the discharge part 52 continuously discharges the rib material.

During discharge of the rib material, the control part 6 drives the motor 21 of the stage transfer mechanism 2 to continuously transfer the stage 3 from a position indicated by the phantom line of FIG. 1 to a position indicated by the solid line in a direction indicated by the arrow 31. As a result, the group of discharge ports 71 travel relatively to the substrate 9 in the (+X) direction along a main surface of the substrate 9, and rib material 91 are sequentially adhered onto the substrate 9, to form the barrier ribs 92.

The irradiation part 53 is disposed behind the discharge part 52 in its traveling direction (relative to the substrate 9) and emits ultraviolet rays while traveling together with the discharge part 52 relatively to the substrate 9, to sequentially irradiate the rib material 91 on the substrate 9 immediately after the discharge with the ultraviolet rays. Since a resin having the property of being hardened by ultraviolet rays is mixed into the rib material 91, the barrier ribs 92 can keep their stable shapes after the passing of the irradiation part 53. As a result, it is possible to prevent deformation of the barrier rib 92 on the substrate 9 and form the barrier rib 92 having a large ratio (H/W) of height (H) (length in the Z direction) to the length (W) (length in the Y direction) of a portion adhered on the substrate 9.

During discharge of the rib material, the head part 5 is also oscillated by the oscillating mechanism 4. The oscillation is made with an amplitude of a quarter of the pitch P1 of the discharge ports 711 or smaller in the Y direction parallel to the main surface of the substrate 9 and perpendicular to a direction of relative travel of the discharge part 52. For example, such a setting is possible as the travel speed of the head part 5 relative to the substrate 9 in the (+X) direction is 10 mm/s, the pitch P1 is 600 μm, the frequency is about 17 Hz and the amplitude of oscillation is 120 μm (the width of oscillation is 240 μm). With such a setting, as shown in FIG. 4, the barrier ribs 92 formed on the substrate 9 makes a waveform along the locus of the discharge port 711. Though FIG. 4 shows the barrier ribs 92 each formed in a sine curve, the barrier ribs 92 may each make other shape similar to that of FIG. 4 (e.g., a shape like line graph).

Figure 5:
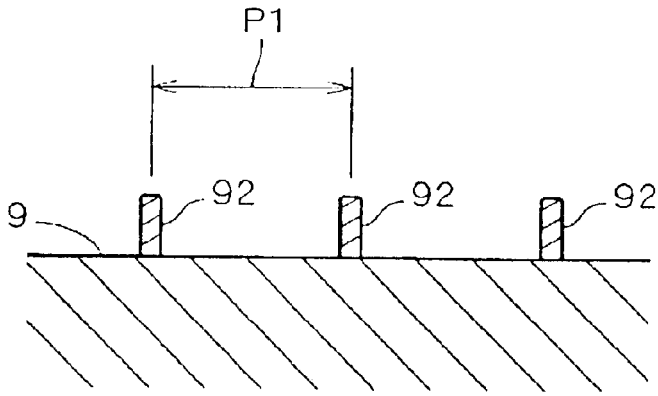
FIG. 5 is a view showing a cross section of the substrate taken along a line indicated by the arrow V—V of FIG. 4.

FIG. 5 is a view showing a cross section of the substrate 9 taken along a line indicated by the arrow V—V of FIG. 4. When the head part 5 once travels relatively to the substrate 9, the barrier ribs 92 are formed at the pitch P1 as shown in FIG. 5. Since hardening is performed by the ultraviolet rays immediately after the discharge, the barrier ribs 92 each having high aspect ratio and high accuracy of form can be formed. The hardening in formation of the barrier ribs should be performed to only such a degree that the shape of the barrier ribs may be stably kept.

Figure 6:
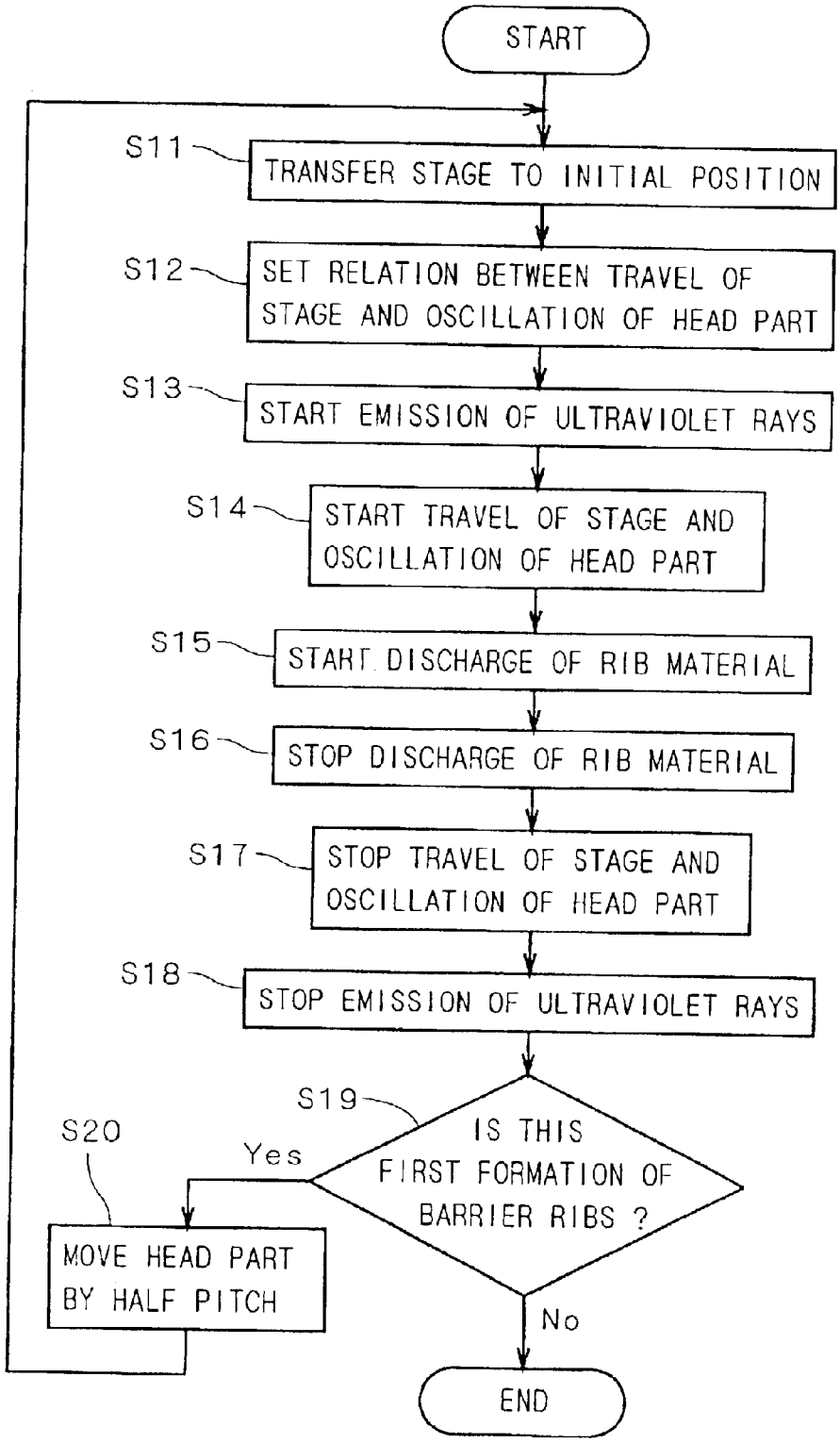
FIG. 6 is a flowchart showing an operation of the barrier-rib forming apparatus.

FIG. 6 is a flowchart showing an operation of the barrier-rib forming apparatus 1. The barrier-rib forming apparatus 1 repeatedly performs the above operation of forming the barrier ribs twice in the same area on the substrate 9.

First, the stage 3 is transferred to an initial position indicated by the phantom line of FIG. 1 (Step S11), and a relation between a position of the stage 3 in the X direction during travel and a position of the head part 5 in the Y direction during oscillation (i.e., a relation between the travel of the stage 3 and the oscillation of the head part 5) is set (Step S12). Since the oscillation of the head part 5 is performed periodically, actual setting is made so that the head part 5 during oscillation may lie at a specific position when the stage 3 passes a reference position. For example, if the head part 5 makes a simple harmonic oscillation, setting is made so that the head part 5 may lie at a specific phase of the simple harmonic oscillation when the stage 3 passes the reference position.

After that, the irradiation part 53 starts emission of ultraviolet rays (Step S13). Further, the stage transfer mechanism 2 starts to transfer the stage 3 in the (−X) direction and the oscillating mechanism 4 starts to oscillate the head part 5 in synchronization with the travel of the stage 3 (Step S14).

When the head part 5 reaches a discharge start position near an end of the substrate 9 (near a left end of the substrate 9 in FIG. 1), the discharge part 52 starts discharge of the rib material (Step S15), to form a plurality of barrier ribs each of periodic waveform as shown in FIG. 4. Then, when the head part 5 reaches a discharge stop position near the other end of the substrate 9 (near a right end of the substrate 9 in FIG. 1), the discharge part 52 stops the discharge of the rib material (Step S16), and the travel of the stage 3, the oscillation of the head part 5 and the emission of the ultraviolet rays are stopped (Steps S17 and S18).

When the first formation of barrier ribs is completed, the head part 5 moves in the Y direction by a distance of half the pitch P1 of the discharge ports 711, and the Steps S11 to S18 are repeated (Steps S19 and S20). In other words, the stage 3 is returned to the initial position and the travel of the stage 3, the oscillation of the head part 5, the discharge of the rib material and irradiation of the barrier ribs with the ultraviolet rays are performed again. At this time, in Step S12, the relation between the travel of the stage 3 and the oscillation of the head part 5 is changed. Specifically, the oscillation of the head part 5 is reversed with respect to the travel of the stage 3. If the head part 5 performs a simple harmonic oscillation, the phase of oscillation may be shifted by 180° with respect to the stage 3.

When the second travel of the stage 3 is completed, the formation of the barrier ribs by the barrier-rib forming apparatus 1 is completed.

Figure 7:
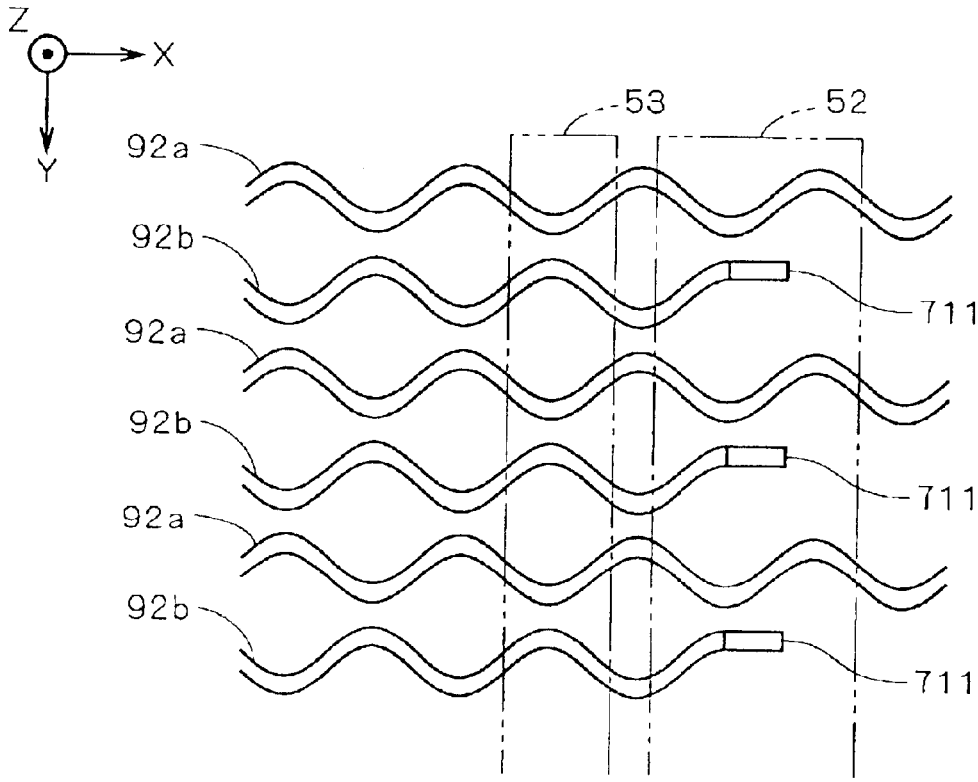
FIG. 7 is a plan view showing a state where the barrier ribs are formed by the second travel of a stage.

FIG. 7 is a plan view showing a state where the barrier ribs are formed by the second travel of the stage 3. In FIG. 7, the barrier ribs formed by the first travel of the stage 3 are represented by sign 92*a* and those formed by the second travel of the stage 3 are represented by sign 92*b*.

As discussed earlier, since the head part 5 having the discharge part 52 moves by the distance of half the pitch P1 of the discharge ports 711 in the second travel of the stage 3, a plurality of barrier ribs 92*b* are each formed between the adjacent barrier ribs 92*a*. Further, since the oscillation position of the head part 5 relative to the stage 3 (the distance of travel from the center of oscillation in the Y direction) is reversed between the first and second travels of the stage 3, a plurality of barrier ribs 92*b* and a plurality of barrier ribs 92*a* are alternately disposed, and adjacent barrier ribs 92*a* and 92*b* are symmetrical to each other with respect to (an axis parallel to) the X direction. The amplitude of oscillation is set slightly smaller than the quarter of the pitch P1 and a clearance is provided between the adjacent barrier ribs 92*a* and 92*b*.

Figure 8:
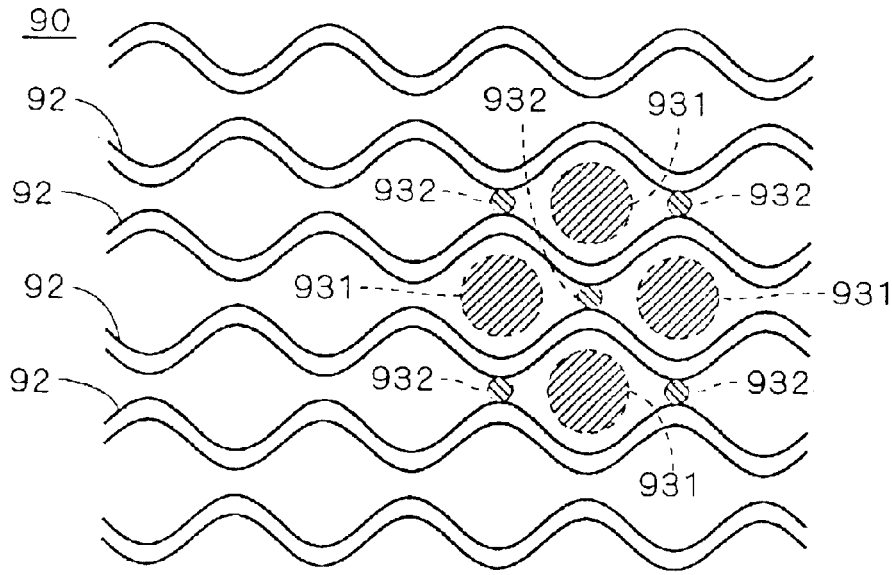
FIG. 8 is a view showing a panel.

FIG. 8 is a view showing a panel 90 for a plasma display, which is manufactured by forming the pseudo-grating barrier ribs 92 on the substrate 9 through the above processes and additionally burning at a temperature of 500 to 600° C. When the panel 90 is used for assembling of the plasma display, it is assumed that an area having a long distance between the barrier ribs 92 is a luminescent area 931 and that having a short distance between the barrier ribs 92 is a non-luminescent area 932.

Since this suppresses discharge interference between cells (each of which is an area for one color of one pixel), the non-luminescent area can be made smaller and the luminescent area can be made larger as compared with a case where the barrier ribs are linearly formed. As a result, it is possible to improve the luminance of the plasma display, utilizing the technique of forming the barrier ribs at low cost by discharging the rib material from the discharge ports.

<2. The Second Preferred Embodiment>

Figure 9:
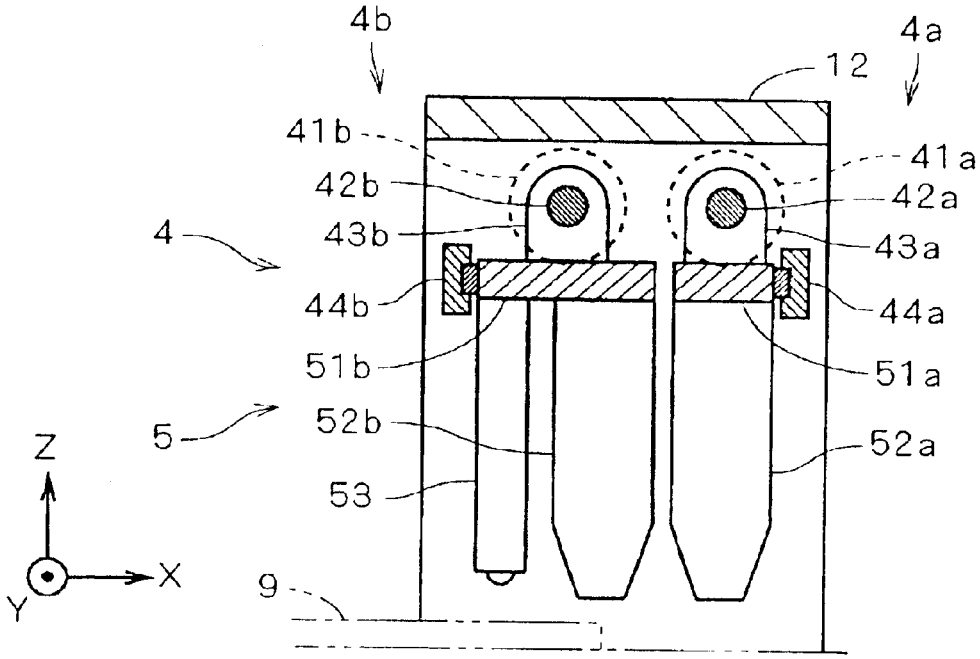
FIG. 9 is a view showing an oscillating mechanism and a head part of a barrier-rib forming apparatus in accordance with a second preferred embodiment.

FIG. 9 is a view showing the oscillating mechanism 4 and the head part 5 of a barrier-rib forming apparatus in accordance with the second preferred embodiment. Other constituents of the barrier-rib forming apparatus are the same as those of the first preferred embodiment and represented by the same signs.

In the barrier-rib forming apparatus of the second preferred embodiment, the oscillating mechanism 4 has two oscillating mechanism elements 4*a* and 4*b* provided in the frame 12. Each oscillating mechanism element 4*a* or 4*b* has the same constitution as the oscillating mechanism 4 of the first preferred embodiment. Specifically, the oscillating mechanism element 4*a* has a motor 41*a*, a ball screw 42*a*, a nut 43*a* and a guide rail 44*a*, and the oscillating mechanism element 4*b* has a motor 41*b*, a ball screw 42*b*, a nut 43*b* and a guide rail 44*b*.

The head part 5 has a first discharge part 52*a*, a second discharge part 52*b* and the irradiation part 53 provided in this order from the side of (+X), and the first discharge part 52*a* is provided on a base 51*a* and the base 51*a* is connected to the nut 43*a*. The second discharge part 52*b* and the irradiation part 53 are provided on a base 51*b* and the base 51*b* is connected to the nut 43*b*. With this structure, the first discharge part 52*a* and the second discharge part 52*b* can be individually oscillated by two oscillating mechanism elements 4*a* and 4*b*, respectively. When the stage 3 travels, the first discharge part 52*a* together with the second discharge part 52*b* travel relatively to the substrate 9.

Figure 10:
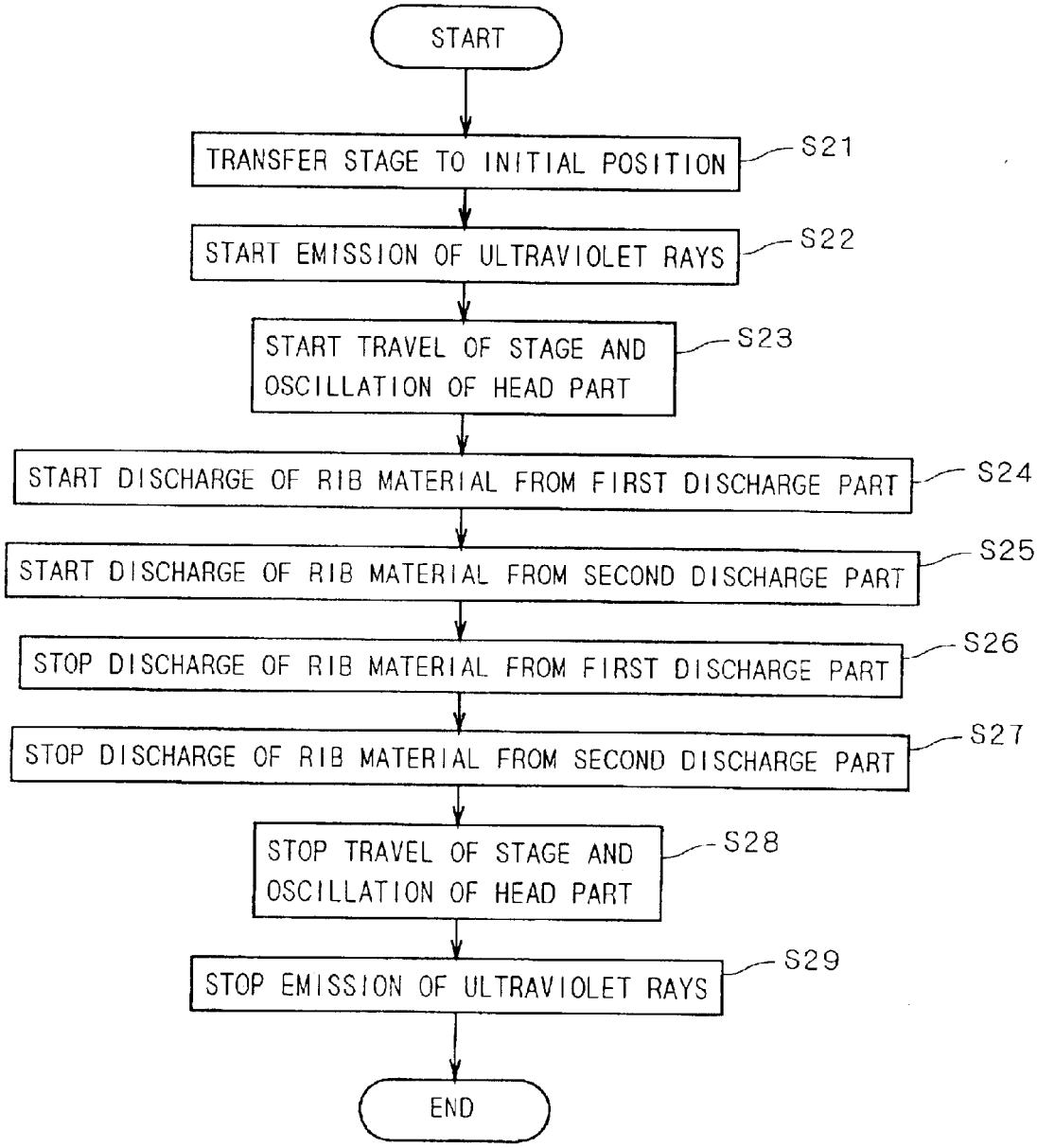
FIG. 10 is a flowchart showing an operation of the barrier-rib forming apparatus.
Figure 11:
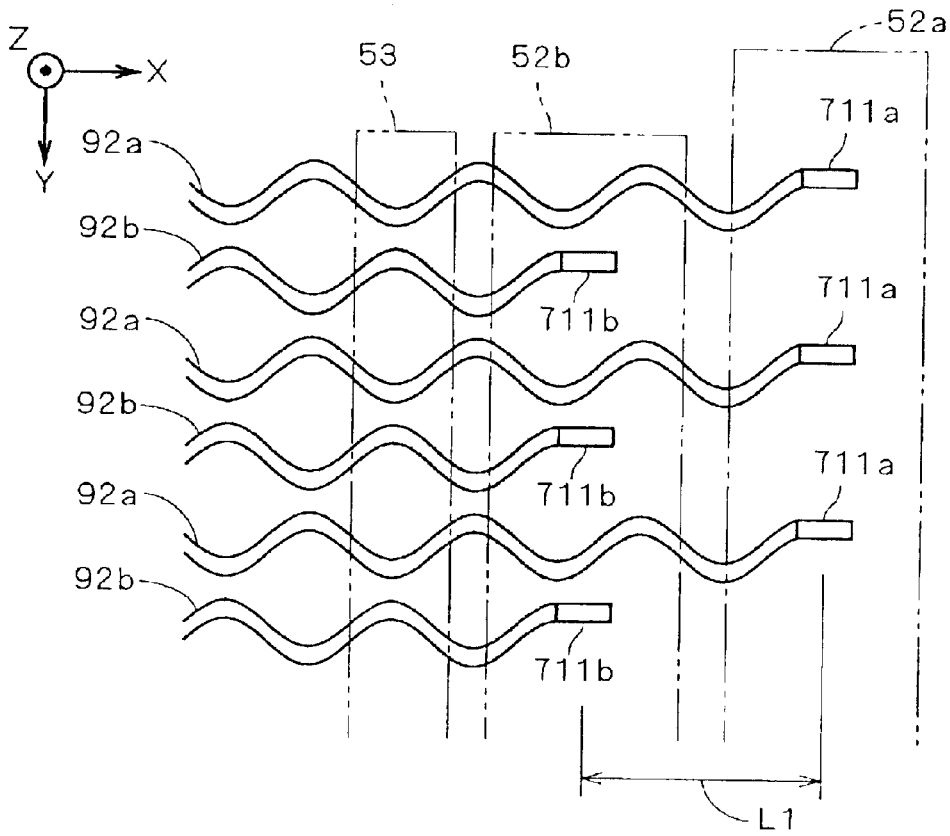
FIG. 11 is a plan view showing a state where the barrier ribs are formed.

FIG. 10 is a flowchart showing an operation of the barrier-rib forming apparatus, and FIG. 11 is a plan view showing a state where the barrier ribs are formed by the oscillating mechanism 4 and the head part 5 of FIG. 9.

First, the stage 3 is transferred to an initial position (Step S21), and the irradiation part 53 starts emission of ultraviolet rays (Step S22). Then, the travel of the stage 3 in the (−X) direction and the oscillation of the head part 5 (specifically, individual oscillations of the first discharge part 52*a* and the second discharge part 52*b*) start (Step S23). At this time, a relation between the travel of the stage 3 and the oscillations by the oscillating mechanism elements 4*a* and 4*b* is set in advance, and according to this setting, the control part 6 (see FIG. 1) synchronously controls the motor 21 and the motors 41*a* and 41*b*.

When the first discharge part 52*a* reaches the discharge start position near an end of the substrate 9 (near the left end of the substrate 9 in FIG. 1), the first discharge part 52*a* starts discharge of the rib material (Step S24), and when the second discharge part 52*b* reaches the discharge start position on the substrate 9, the second discharge part 52*b* starts discharge of the rib material (Step S25). These starts of discharges may be simultaneously made, but with sequential starts as above, it is possible to make all the starting points of the barrier ribs coincident with the discharge start position on the substrate 9.

The oscillations of the first discharge part 52*a* and the second discharge part 52*b* are controlled so that a plurality of barrier ribs 92*a* formed by the first discharge part 52*a* and a plurality of barrier ribs 92*b* formed by the second discharge part 52*b* may be alternately disposed without mutual interference and adjacent barrier ribs 92*a* and 92*b* may be symmetrical to each other with respect to (an axis parallel to) the X direction (i.e., a traveling direction of the head part 5 relative to the substrate 9) as shown in FIG. 11. In other words, assuming that the distance between the discharge port 711*a* of the first discharge part 52*a* and the discharge port 711*b* of the second discharge part 52*b* is L1, the second discharge part 52*b* oscillates, lagging an oscillating cycle corresponding to the distance L1 behind the first discharge part 52*a*, symmetrically to the first discharge part 52*a* (with a phase lag of 180° if simple harmonic oscillation).

The irradiation part 53 sequentially irradiates both the barrier ribs 92*a* and the barrier ribs 92*b* with the ultraviolet rays, to harden these barrier ribs 92*a* and 92*b* by one operation. This makes it possible to form the barrier ribs each having high aspect ratio like in the first preferred embodiment.

When the first discharge part 52*a* reaches the discharge stop position near the other end of the substrate 9 (near the right end of the substrate 9 in FIG. 1) while forming the barrier ribs, the first discharge part 52*a* stops the discharge of the rib material (Step S26), and when the second discharge part 52*b* reaches the discharge stop position on the substrate 9, the second discharge part 52*b* steps the discharge of the rib material (Step S27). These stops of discharges may be simultaneously made, but with sequential stops as above, it is possible to make all the ending points of the barrier ribs coincident with the discharge stop position on the substrate 9.

When the discharges are stopped, the travel of the stage 3, the oscillation of the head part 5 (specifically, the oscillations of the first discharge part 52*a* and the second discharge part 52*b*) are stopped (Step S28), and the emission of the ultraviolet rays is also stopped (Step S29).

As discussed above, in the barrier-rib forming apparatus of the second preferred embodiment, all the required barrier ribs of waveform can be formed in an area scanned by the head part 5 through one travel of the stage 3 (specifically, one travel of the head part 5 relative to the substrate 9). This makes it possible to form the barrier ribs which allow reduction of the non-luminescent area for a short time.

<3. The Third Preferred Embodiment>

Figure 12:
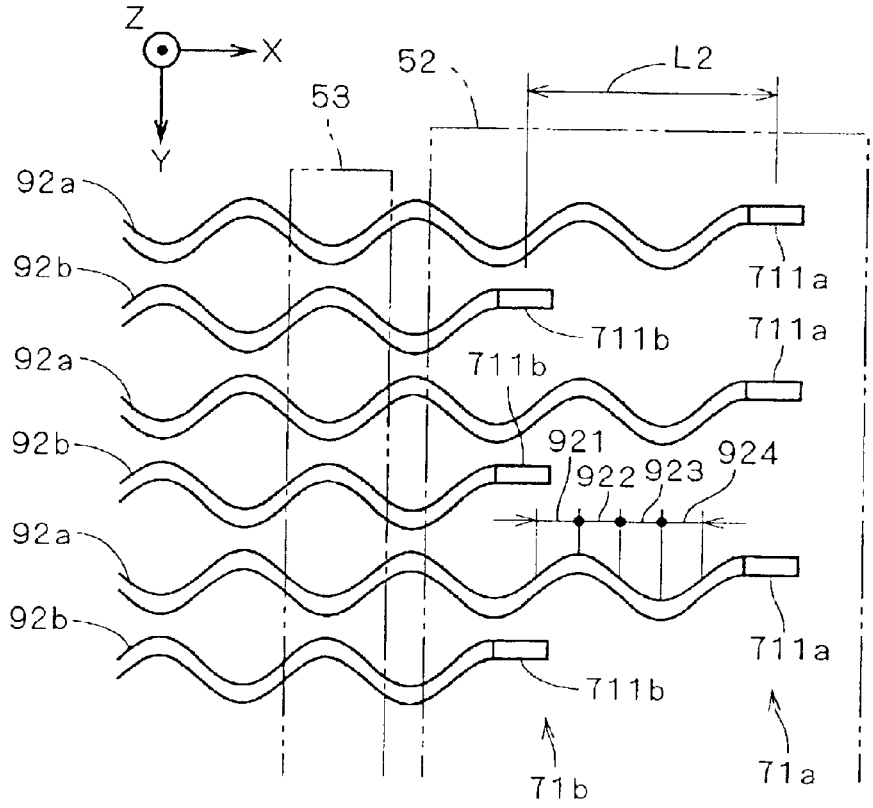
FIG. 12 is a plan view showing a state where a discharge part in accordance with a third preferred embodiment discharges rib material to the substrate.

FIG. 12 is a plan view showing a state where the discharge part 52 discharges the rib material onto the substrate 9 in a barrier-rib forming apparatus in accordance with the third preferred embodiment. The barrier-rib forming apparatus of the third preferred embodiment has a difference in that the discharge part 52 has a first group of discharge ports 71*a* and a second group of discharge ports 71*b* arranged in two rows.

The first group of discharge ports 71*a* has the same function as a group of discharge ports 711*a* in the first discharge part 52*a* of the second preferred embodiment and the second group of discharge ports 71*b* has the same function as a group of discharge ports 711*b* in the second discharge part 52*b* (the discharge ports are represented by the above signs in FIG. 12). In other words, the discharge part 52 of the third preferred embodiment has a united structure of the first discharge part 52*a* and the second discharge part 52*b* of the second preferred embodiment. An operation of the barrier-rib forming apparatus is also the same as that of FIG. 10 except that only one discharge part 52 operates, and the barrier ribs formed through this operation are hardened by the ultraviolet rays emitted from the irradiation part 53 by one operation.

In the discharge part 52 of FIG. 12, the first group of discharge ports 71*a* and the second group of discharge ports 71*b* simultaneously perform the same oscillation. Therefore, assuming that loci which the discharge port draws on the substrate 9 while traveling from the center of oscillation by the quarter of cycle are the first to fourth loci 921 to 924 as shown in FIG. 12, the first locus 921 and the second locus 922 are symmetrical with respect to (an axis parallel to) the Y direction (a direction of oscillation) with an ending point of the first locus 921 as the center, the second locus 922 and the third locus 923 are point-symmetrical with an ending point of the second locus 922 as the center, the third locus 923 and the fourth locus 924 are symmetrical with respect to the Y direction with an ending point of the third locus 923 as the center and the fourth locus 924 and the first locus 921 of the next cycle are point-symmetrical with an ending point of the fourth locus 924 as the center. A distance L2 between the first group of discharge ports 71*a* and the second group of discharge ports 71*b* is almost equal to a distance covered by the discharge part 52 during oscillation of the discharge part 52 by an integral multiple of cycle and a half.

This makes it possible that a plurality of barrier ribs 92*a* formed by the first group of discharge ports 71*a* and a plurality of barrier ribs 92*b* formed by the second group of discharge ports 71*b* are alternately disposed and the adjacent barrier ribs 92*a* and 92*b* are symmetrical with respect to (an axis parallel to) the X direction (i.e., a traveling direction of the head part 5 relative to the substrate 9). Since it is not needed, however, that the barrier ribs 92*a* and the 92*b* should be exactly symmetrical to each other, the conditions of the above locus and the distance L2 has only to be easily satisfied.

As discussed above, in the barrier-rib forming apparatus of the third preferred embodiment, all the required barrier ribs of waveform can be formed in the area scanned by the head part 5 through one travel of the stage 3 (in other words, through one travel of the head part 5 relative to the substrate 9) with only one discharge part 52. This makes it possible to reduce the manufacturing cost of the barrier-rib forming apparatus and form the barrier ribs which allow reduction of the non-luminescent area for a short time.

<4. The Fourth Preferred Embodiment>

Figure 13:
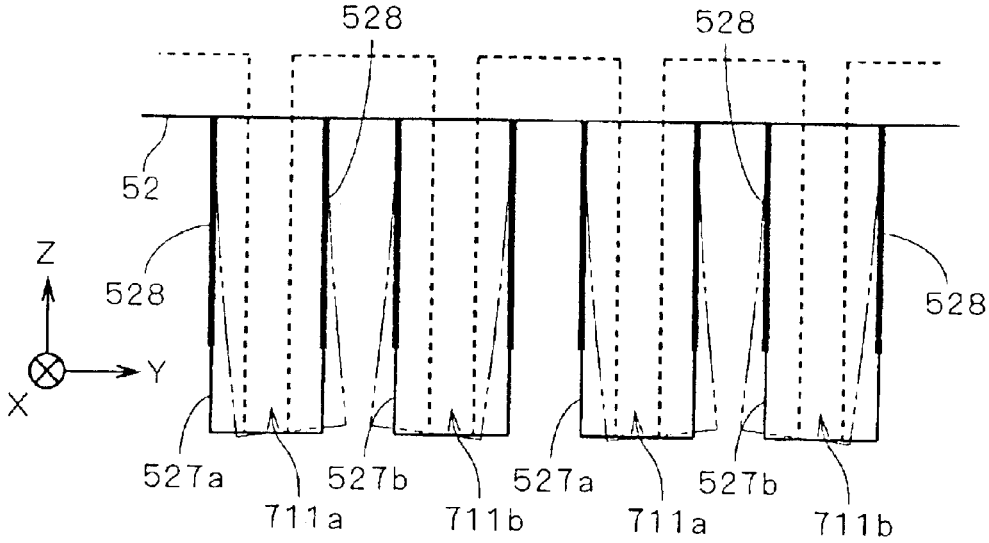
FIG. 13 is a view showing an end of the discharge part of a barrier-rib forming apparatus in accordance with a fourth preferred embodiment.

FIG. 13 is a view showing an end of the discharge part 52 of a barrier-rib forming apparatus in accordance with the fourth preferred embodiment. Other constituents of the barrier-rib forming apparatus are the same as those of the first preferred embodiment and an operation of this apparatus is the same as that consisting of Steps S11 to S18 of FIG. 6.

In the barrier-rib forming apparatus of the fourth preferred embodiment, first nozzles 527*a* and second nozzles 527*b* are alternately formed on an end of the discharge part 52, and the first discharge port 711*a* is formed at an end of the first nozzle 527*a* and the second discharge port 711*b* is formed at an end of the second nozzle 527*b*. Each nozzle is made of piezo element such as PZT (lead zirconate titanate) and provided with a pair of electrodes 528 on its side surfaces.

The same voltage is applied across the respective paired electrodes of a group of first nozzles 527*a* (hereinafter, referred to as "first group of nozzles") by the control part 6 (see FIG. 1) and the first group of nozzles equally oscillate in the Y direction (i.e., a direction perpendicular to the traveling direction of the head part 5 relative to the substrate 9). The same voltage is also applied across the respective paired electrodes of a group of second nozzles 527*b* (hereinafter, referred to as "second group of nozzles") by the control part 6 (see FIG. 1) and the second group of nozzles equally oscillate in the Y direction. This makes it possible to individually control of oscillations of the first group of nozzles and the second group of nozzles.

The control part 6 controls the first nozzle 527*a* and the second nozzle 527*b* to oscillate in opposite directions. As a result, a plurality of first discharge ports 711*a* and a plurality of second discharge ports 711*b* discharge the rib material onto the substrate 9 while the first group of nozzles and the second group of nozzles are individually controlled to oscillate, to form the barrier ribs, as shown in FIG. 8, on the substrate 9 which travels in the X direction. Specifically, a plurality of barrier ribs formed by the first group of nozzles and a plurality of barrier ribs formed by the second group of nozzles are alternately disposed and adjacent barrier ribs are symmetrical to each other with respect to (an axis parallel to) the X direction.

As discussed above, in the barrier-rib forming apparatus of the fourth preferred embodiment, by oscillating very small nozzles each having one discharge port, all the required barrier ribs of waveform can be formed in the area scanned by the head part 5 through one travel of the stage 3 (in other words, through one travel of the head part 5 relative to the substrate 9) with only one discharge part 52. This makes it possible to reduce the size of the barrier-rib forming apparatus and form the barrier ribs which allow reduction of the non-luminescent area for a short time.

Since the oscillation of each nozzle can be independently controlled, it is not needed to provide the first group of nozzles and the second group of nozzles linearly in the Y direction. Naturally, providing the first group of nozzles and the second group of nozzles linearly in the Y direction (oscillating direction) makes it possible to make all the starting points and ending points of the barrier ribs coincident with one another without independently control each nozzle to discharge the rib material.

<5. Variation>

Though the preferred embodiments of the present invention have been discussed above, the present invention is not limited to the above-discussed preferred embodiments but allows various variations.

The barrier-rib forming apparatus can be used not only for manufacture of the panel used for the plasma display but also for panels having barrier ribs used for other flat panel displays (FPDs) such as an organic EL display, and this produces an effect of improving the luminance of the flat panel display. Further, the substrate 9 is also not limited to the glass substrate.

Though the head part 5 travels relatively to the substrate 9 with the travel of the stage 3 in the above-discussed preferred embodiments, the head part 5 may travel with the stage 3 fixed. The width of the discharge part may be shorter than a length of crossing the substrate 9, and in this case, the discharge part travels in a direction perpendicular to the traveling direction of the discharge part relative to the substrate 9 (in the Y direction of FIG. 1), to repeatedly discharge the rib material to other areas.

The travel of the head part 5 relative to the substrate 9 is not limited to one way, but the head part 5 may be travel to and fro while discharging the rib material. In this case, for example, the irradiation parts 53 are provided on both front and rear sides of the discharge part 52 and only the rear irradiation part 53 is lighted, or the head part 5 rotates in accordance with the traveling direction.

The discharge part may oscillate relatively to the substrate 9. For example, the stage 3 may oscillate while the head part 5 travels in the first or third preferred embodiments.

Figure 14:
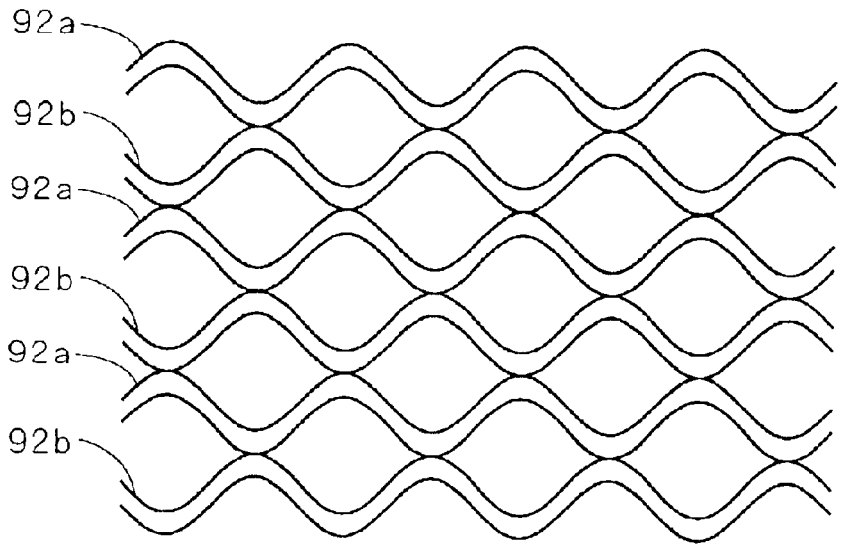
FIGS. 14 and 15 are views showing another barrier ribs.

Though the barrier ribs 92 are separated away from one another in the panel 90 of FIG. 8 in order for quick exhaust of air in sealing the panel 90 together with other panels in assembly of the display, the adjacent barrier ribs 92*a* and 92*b* are in contact with each other as shown in FIG. 14.

Figure 15:
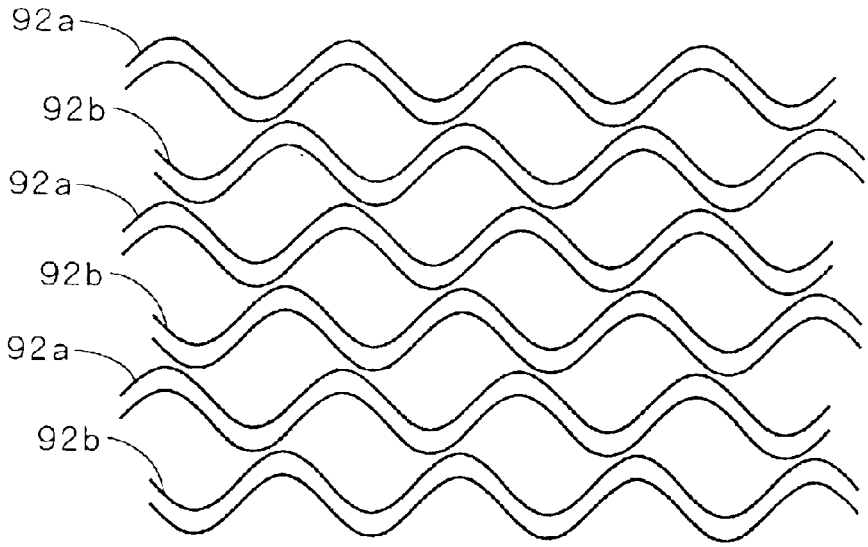

Though the barrier ribs each having a form of sine curve are shown in the figure used for the above discussion of the preferred embodiments, only if the barrier ribs form a pseudo-grating pattern, other forms (e.g., forms like line graph having trapezoid, triangle or the like in half cycle) may be adopted and it is not needed that adjacent barrier ribs should be completely symmetrical to each other with respect to an extending direction of the barrier ribs. FIG. 15 is a view showing a state where a clearance is intentionally and surely provided between the adjacent barrier ribs 92*a* and 92*b* by slightly shifting the barrier rib 92*b* with respect to the barrier rib 92*a* in a forming direction of the barrier ribs when the barrier ribs draw sine curves.

Though the barrier ribs on the substrate 9 are hardened by the ultraviolet rays immediately after discharge, the barrier ribs may be hardened, not only by the ultraviolet rays or other kinds of lights, but also by heat, oxygen gas, humid gas or the like.

Though the nozzle is oscillated by the piezo element in the fourth preferred embodiment, the nozzle may be oscillated by other kinds of electrostriction materials or by repeating resistance heat and heat radiation through carrying a current to a material having property of being transformed by heat, such as bimetal. Further, a magnetostriction material may be used for the nozzle.

The shape of discharge port may be changed as appropriate, and for example, the shape of discharge port may be ellipse, triangle, polygon or the like.

While the invention has been shown and described in detail, the foregoing description is in all aspects illustrative and not restrictive. It is therefore understood that numerous modifications and variations can be devised without departing from the scope of the invention.

What is claimed is:

1. An apparatus for forming barrier ribs on a substrate for a flat panel display, comprising:

a discharge part having a group of discharge ports for discharging rib material to said substrate;

a transfer mechanism for transferring said discharge part relatively to said substrate in a first direction along a main surface of said substrate; and an oscillating mechanism for oscillating said discharge part relatively to said substrate in a second direction which is perpendicular to said first direction and parallel to said main surface.

2. The apparatus according to claim 1, further comprising a control part for synchronizing an operation of said transfer mechanism with that of said oscillating mechanism, wherein a plurality of first barrier ribs are formed by the first travel of said discharge part and a plurality of second barrier ribs are formed by the second travel of said discharge part, and said control part controls said operations so that said plurality of second barrier ribs are disposed alternately with said plurality of first barrier ribs and adjacent ones are almost symmetrical to each other with respect to an axis parallel to said first direction.

3. The apparatus according to claim 1, further comprising:

another discharge part positioned in said first direction with respect to said discharge part, being transferred by said transfer mechanism together with said discharge part and oscillated by said oscillating mechanism; and a control part for synchronizing an operation of said transfer mechanism with that of said oscillating mechanism, wherein said another discharge part oscillates in synchronization with oscillation of said discharge part, a plurality of first barrier ribs are formed by travel of said discharge part and a plurality of second barrier ribs are formed by travel of said another discharge part, and said control part controls said operations so that said plurality of second barrier ribs are disposed alternately with said plurality of first barrier ribs and adjacent ones are almost symmetrical to each other with respect to an axis parallel to said first direction.

4. The apparatus according to claim 1, further comprising:

a control part for synchronizing an operation of said transfer mechanism with that of said oscillating mechanism, wherein said group of discharge ports includes a first group of discharge ports aligned in said second direction at a predetermined pitch and a second group of discharge ports aligned in said second direction at said predetermined pitch, being shifted by half pitch with respect to said first group of discharge ports, and a distance between said first group of discharge ports and said second group of discharge ports is almost equal to a distance covered by said discharge part during oscillation of said discharge part by an integral multiple of cycle and a half.

5. The apparatus according to claim 1, further comprising a hardening part traveling together with said discharge part over said barrier ribs formed by said discharge part, for sequentially hardening said barrier ribs.

6. An apparatus for forming barrier ribs on a substrate for a flat panel display, comprising:

a discharge part having a first group of nozzles and a second group of nozzles each for discharging rib material to said substrate;

a transfer mechanism for transferring said discharge part relatively to said substrate in a first direction along a main surface of said substrate; and an oscillating mechanism for individually oscillating said first group of nozzles and said second group of nozzles in a second direction which is perpendicular to said first direction and parallel to said main surface.

7. The apparatus according to claim 6, further comprising a hardening part traveling together with said discharge part over said barrier ribs formed by said discharge part, for sequentially hardening said barrier ribs.

8. A method of forming barrier ribs on a substrate for a flat panel display, comprising:

a discharge start step for starting discharge of rib material from a group of discharge ports while transferring said group of discharge ports relatively to said substrate in a first direction along a main surface of said substrate; and a discharge stop step for stopping said discharge of said rib material from said group of discharge ports, wherein said group of discharge ports oscillate relatively to said substrate in a second direction which is perpendicular to said first direction and parallel to said main surface during a period from said discharge start step to said discharge stop step.

9. The method according to claim 8, further comprising a repeat step for repeating said discharge start step and said discharge stop step, wherein a plurality of first barrier ribs formed on said substrate in the first execution of said discharge start step and said discharge stop step and a plurality of second barrier ribs formed on said substrate in the second execution of said discharge start step and said discharge stop step are alternately disposed and adjacent ones are almost symmetrical to each other with respect to an axis parallel to said first direction.

10. The method according to claim 8, further comprising:

another discharge start step for starting discharge of rib material from another group of discharge ports while transferring said another group of discharge ports together with said group of discharge ports; and another discharge stop step for stopping said discharge of said rib material from said another group of discharge ports, wherein said another group of discharge ports oscillate in said second direction in synchronization with oscillation of said group of discharge ports during said discharge of said rib material, and a plurality of first barrier ribs formed on said substrate from said discharge start step to said discharge stop step and a plurality of second barrier ribs formed on said substrate from said another discharge start step to said another discharge stop step are alternately disposed and adjacent ones are almost symmetrical to each other with respect to an axis parallel to said first direction.

11. The method according to claim 8, further comprising a step of sequentially hardening said rib material discharged on said substrate during said period from said discharge start step to said discharge stop step.

12. A panel for a flat panel display, comprising:

a substrate; and a plurality of barrier ribs formed of rib material discharged on said substrate from a group of discharge ports, wherein said plurality of barrier ribs each form a periodic waveform extending in a predetermined direction and adjacent ones of said plurality of barrier ribs are almost symmetrical to each other with respect to an axis parallel to said predetermined direction.

* * * * *

UNITED STATES PATENT AND TRADEMARK OFFICE

CERTIFICATE OF CORRECTION

PATENT NO. : 7,040,945 B2
APPLICATION NO. : 10/322707
DATED : May 9, 2006
INVENTOR(S) : Manabu Yabe It is certified that error appears in the above-identified patent and that said Letters Patent is hereby corrected as shown below:

TITLE PAGE, item (56), line 3, under "FOREIGN PATENT DOCUMENTS",
Change third-listed reference from "JP 2001-0003183 1/2001" to
-- KR 2001-0003183 1/2001 --;

On the title page under item (57), at the bottom of right-hand column, change "12 Claims" to -- 11 Claims --;

IN THE CLAIMS
Column 12, delete Claim 12 in its entirety.

Signed and Sealed this

Twenty-first Day of November, 2006

JON W. DUDAS
*Director of the United States Patent and Trademark Office*